US006264029B1

(12) United States Patent
Motson

(10) Patent No.: US 6,264,029 B1
(45) Date of Patent: Jul. 24, 2001

(54) PORTABLE ORGANIZER

(76) Inventor: W. David Motson, 417 Columbia Blvd., Cherry Hill, NJ (US) 08002

( * ) Notice: Subject to any disclaimer, the term of this patent is extended or adjusted under 35 U.S.C. 154(b) by 0 days.

(21) Appl. No.: 09/559,026

(22) Filed: Apr. 27, 2000

(51) Int. Cl.[7] ..... B65D 85/00
(52) U.S. Cl. ..... 206/320; 206/472
(58) Field of Search ..... 206/305, 320, 206/473, 472, 477, 483, 569; 190/102

(56) References Cited

U.S. PATENT DOCUMENTS

| | | | | |
|---|---|---|---|---|
| 5,855,274 | * | 1/1999 | Piao | 206/472 |
| 6,026,961 | * | 2/2000 | McCarthy et al. | 206/320 |
| 6,126,011 | * | 10/2000 | Ullmann et al. | 206/320 |
| 6,161,979 | * | 1/1999 | Yamamoto et al. | 206/472 |

* cited by examiner

*Primary Examiner*—David T. Fidei
(74) *Attorney, Agent, or Firm*—Norman E. Lehrer

(57) ABSTRACT

A portable organizer which includes a foldable case having an interior compartment is disclosed. The case may have a zipper along its periphery. Located within the compartment are various holders for securing a wide variety of personal organizational items such as business cards, notepads, an identification card, etc. Also located within the compartment is an adjustable clamp which may be used to grip a personal data assistant device. The clamp includes an upper bracket, a lower bracket, and an elastic member attached to the brackets. The lower bracket may be secured to the case. The upper bracket should not be attached to the case. Covering the elastic member is a piece of material sewn or otherwise attached to the case. The cover acts as a guide in order to maintain the clamp in place. A personal data assistant, such as a miniature electronic device or PALM PILOT may be gripped by the clamp by extending the upper bracket upwardly so that the device may rest on the lower bracket and against the covering member. The upper bracket is then released so that the upper bracket grips the device and holds it in place. Rubber or foam pads may be placed on the upper and lower brackets where the device contacts the brackets so that the device is not scratched or otherwise damaged by the brackets.

8 Claims, 2 Drawing Sheets

PORTABLE ORGANIZER

BACKGROUND OF THE INVENTION

The present invention is directed toward an organizer and more particularly, toward a portable organizer which includes a variety of holders which secure various personal organizational items within the organizer including an adjustable clamp which can grip a personal data assistant device.

People today are traveling or are on the road on a daily basis for work or pleasure and are away from their office or home more frequently. As a result, they often find themselves carrying more and more personal and organizational items, such as business cards, credit cards, notebooks, writing implements, and calendars with them. A common way to carry such items is by way of an organizer or portfolio. Typically, an organizer includes a foldable case with a zipper. Within the case are pockets, straps, or other storage compartments so that notebooks, writing implements, and the like may be carried therein. The problem with such cases, however, is that they are not capable of holding devices such as cellular phones and personal data assistant devices which are commonly used today.

U.S. Pat. No. 5,839,553 to Dorsam discloses a briefcase organizer. This device includes a briefcase with cases where each case is essentially a tray of compartments for housing various organizational items such as a stapler, scissors, paper clips, a ruler, etc. The compartments of each tray have a common lid. This organizer, however, would not be suitable for securing a cellular phone or personal data assistant device which should be securely held in place.

A need exists for a portable, compact organizer which is able to securely store a wide variety of organizational items as well as modern conveniences such as personal data assistant devices and cellular phones.

SUMMARY OF THE INVENTION

The present invention is designed to overcome the deficiencies of the prior art discussed above. It is an object of the present invention to provide a portable organizer which includes various holders such as an adjustable clamp.

It is a further object of the present invention to provide an adjustable clamp which may securely hold a personal data assistant device.

In accordance with the illustrative embodiments demonstrating features and advantages of the present invention, there is provided an organizer which includes a foldable case having an interior compartment. The case may have a zipper along its periphery. Located within the compartment are various holders for securing a wide variety of personal organizational items such as business cards, notepads, an identification card, etc. Also located within the compartment is an adjustable clamp which may be used to grip a personal data assistant device. The clamp includes an upper bracket, a lower bracket, and an elastic member attached to the brackets. The lower bracket may be mounted to the case. The upper bracket should not be attached to the case. Covering the elastic member is a piece of material sewn or otherwise attached to the case. The cover acts as a guide in order to maintain the clamp in place. A personal data assistant, such as a miniature electronic device, PALM PILOT, or the like may be gripped by the clamp by extending the upper bracket upwardly so that the device may rest on the lower bracket and against the cover member. The upper bracket is then released so that the upper bracket grips the device and holds it in place. Rubber or foam pads may be placed on the upper and lower brackets where the device contacts the brackets so that the device is not scratched or otherwise damaged by the brackets.

Other objects, features, and advantages of the invention will be readily apparent from the following detailed description of a preferred embodiment thereof taken in conjunction with the drawings.

BRIEF DESCRIPTION OF THE DRAWINGS

For the purposes of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
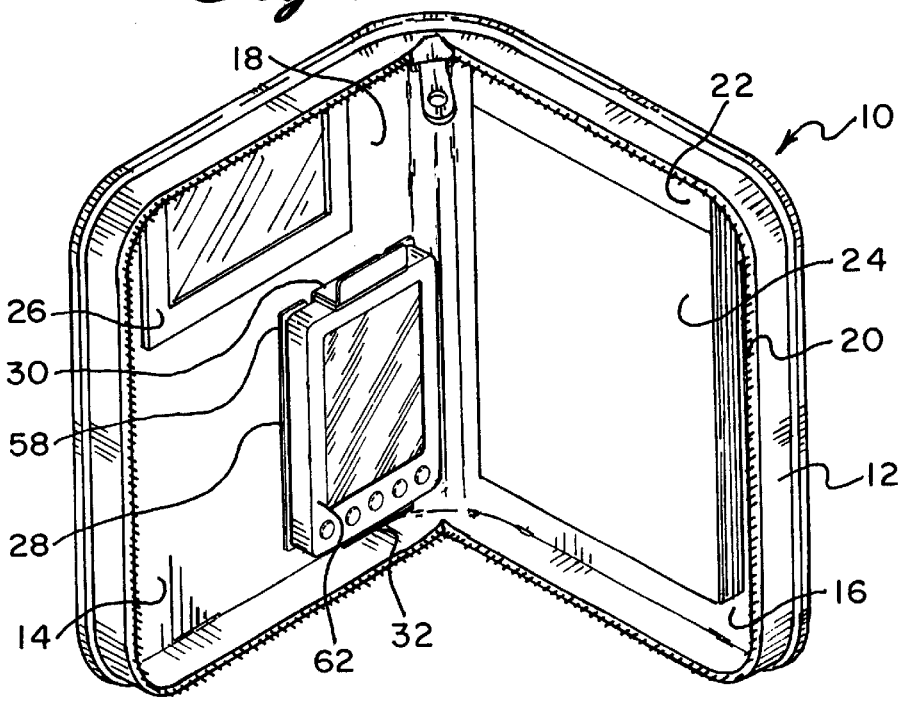
FIG. 1 is a front perspective view of the organizer of the present invention.

Referring now to the drawings in detail wherein like reference numerals have been used throughout the various figures to designate like elements, there is shown in FIG. 1 an organizer constructed in accordance with the principles of the present invention and designated generally as 10.

The organizer includes a foldable case 12 having a left side 14, a right side 16, and an interior compartment 18. Along the periphery of the case 12 is a zipper 20 so that the case 12 may be folded and zippered closed. Secured within the case 12, on the right side 16, is a holder 22 for a notepad 24. A pocket or holder 26 for a personal identification card is secured on the left side 14 and a holder in the form of an adjustable clamp 28 is also secured on the left side. (See FIG. 1.) It should be realized, however, that while only three holders are shown, a number of holders, such as straps, pockets, etc. may be located within the compartment and may hold a variety of personal organizational items such as a cellular phone, business cards, credit cards, keys, writing implements, etc. Furthermore, the arrangement of the holders within the case may vary. Also, it should be realized that the size of the case may vary. The case may be made from leather, vinyl, combinations of leather and fabric, or the like material. The holders may be made from plastic, metal, any like material, or any combinations thereof.

Figure 5:
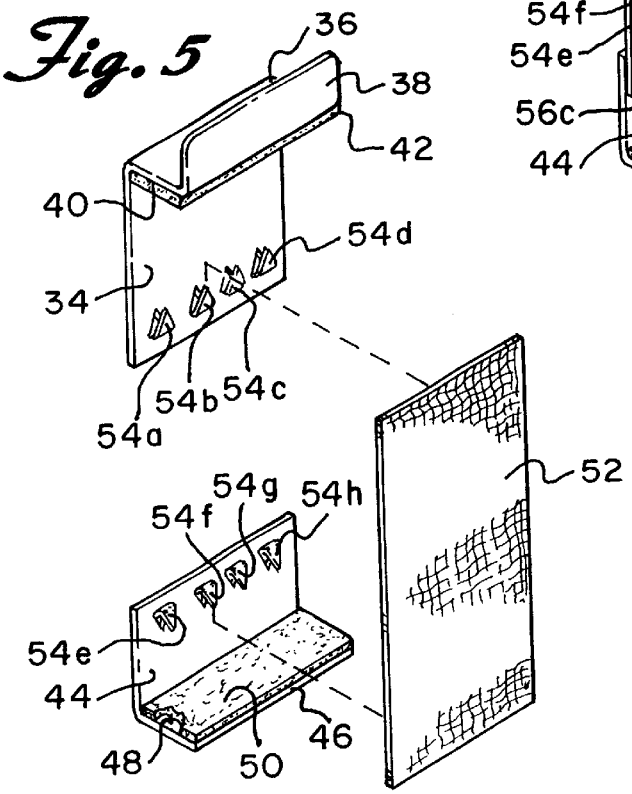
FIG. 5 is an exploded view of the adjustable clamp of the organizer of the present invention.

The adjustable clamp 28 includes an upper bracket 30 and a lower bracket 32. The upper bracket 30 has a back 34 which extends downwardly. Extending outwardly from the top of the back 34 is a front member 36. A flange 38 extends upwardly from the front member 36. (See FIG. 5.) The front member 36 has a downwardly facing surface 40 which has a pad 42 made from rubber, foam, or the like attached thereto. The purpose of the pad will be discussed in greater detail below.

The lower bracket 32 is generally L-shaped and has an upwardly extending back 44 and a bottom member 46 which extends outwardly from the bottom of the back 44. (See FIG. 5.) The bottom member 46 has an upwardly facing surface 48 which also has a pad 50 made from rubber, foam, or the like attached thereto. Again, the purpose of the pad will be discussed in greater detail below.

Figure 4:
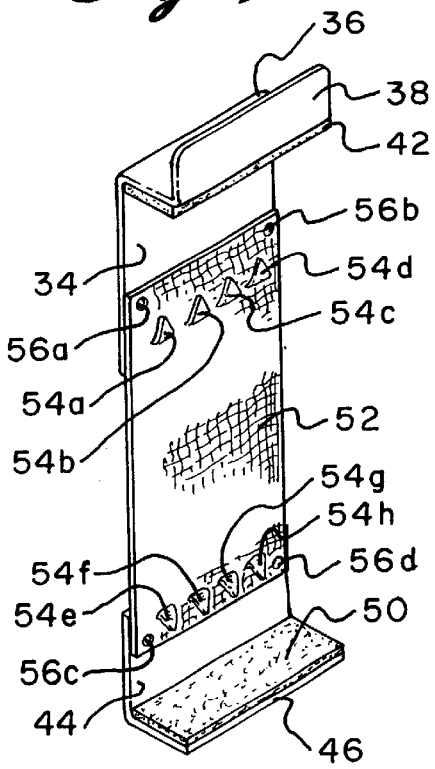
FIG. 4 is a perspective view of the adjustable clamp of the organizer of the present invention disassembled from the organizer.

The clamp 28 also includes an elastic member 52 which extends between the upper bracket 30 and the lower bracket 32 and is attached to the backs 34 and 44. Located along the back 34 of the upper bracket 30 and the back 44 of the lower bracket 32 are means for retaining the elastic member 52 to the brackets 30 and 32. Such means may be prongs 54*a*–54*h* which hook onto the elastic member 52. That is, the prongs 54*a*–54*d* on the back 34 may face upwardly and the prongs 54*e*–54*h* on the back 44 may face downwardly. The elastic member 52 is hooked onto these prongs 54*a*–54*h*. (See FIG. 5.) It should be realized, however, that this is just one example of a means for retaining the elastic member and that other means known in the art may also be used, alone or in combination with each other. For example, as seen in FIG. 4, the elastic member 52 may also be riveted to the upper bracket 30 and to the lower bracket 32 or attached via pins or bolts 56*a*–56*d*.

Figure 3:
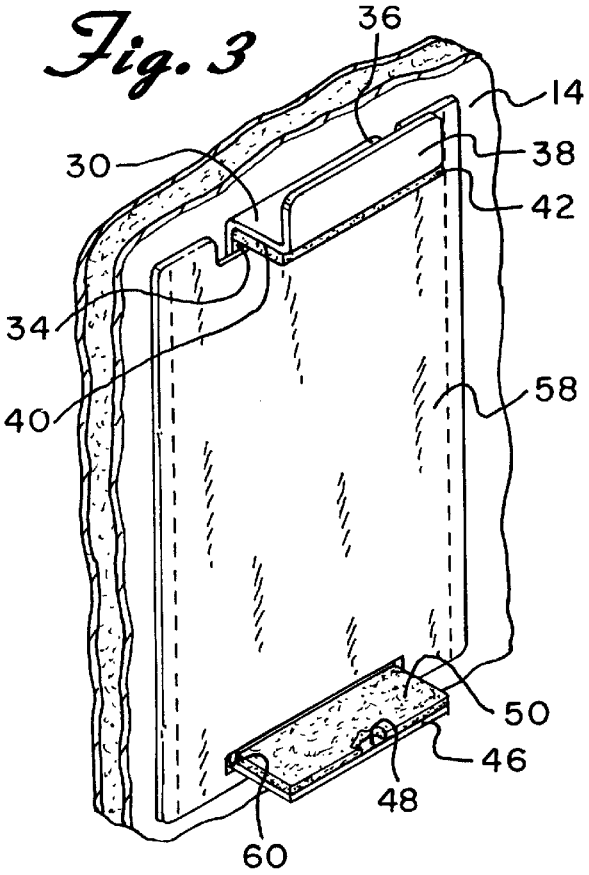
FIG. 3 is a perspective view of the adjustable clamp of the organizer of the present invention without the electronic device.

In order for the clamp 28 to be positioned within the case 12, the upper bracket 30 should not actually be attached to the case. The elastic member 52 is attached to the brackets 30 and 32. The lower bracket 32 is held in place by a cover 58 which is stitched to the left side 14 so that the bottom member 46 extends through a slot 60 in the lower part of the cover 58. The front member 36 and flange 38 of the bracket 30 extend over the top of the cover 58. (See FIG. 3.) The cover 58 acts as a guide or means for maintaining the clamp in place. The cover 58 may be made from fabric, leather, or the like material.

Figure 2:
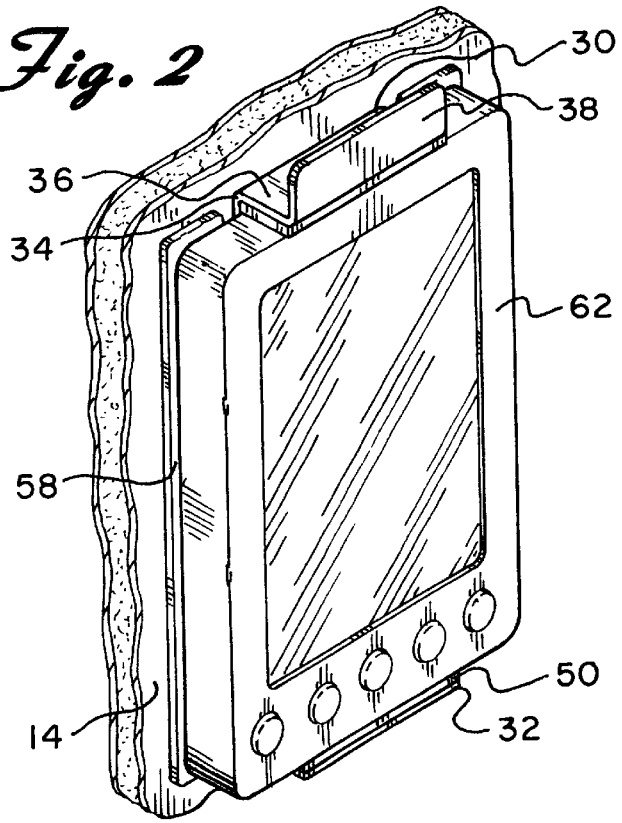
FIG. 2 is a perspective view showing only the adjustable clamp of the organizer of the present invention and a miniature electronic device being held therein.

In order to fit a miniature electronic device 62 such as a PALM PILOT or the like into the clamp, the flange 38 of the upper bracket 30 is grasped by the user and is pushed upwardly so that the device 62 may be properly positioned. That is, the bottom of the device is placed against the pad 50 located on the lower bracket 32 and the back of the device is positioned against the cover 58. The upper bracket 30 may then be released. The pad 42 located on the upper bracket 30 rests against the top of the device 62. The device 62 is now securely held within the clamp 28. (See FIG. 2.) The pads act as buffers or protective means which prevent the device from being scratched or otherwise damaged by the brackets. Furthermore, the elastic member allows height and width adjustments to be made so that differently sized devices may be held by the clamp.

The present invention may be embodied in other specific forms without departing from the spirit or essential attributes thereof and accordingly, reference should be made to the appended claims rather than to the foregoing specification as indicating the scope of the invention.

I claim:

1. A portable organizer comprising:

a foldable case having an interior compartment and a plurality of holders located therein, said plurality of holders including an adjustable clamp for securing a miniature electronic device, said clamp including an upper bracket, a lower bracket, and an elastic member attached to said upper and lower brackets; at least one of said brackets being moveable away from the other of said brackets and said brackets being biased toward each other by said elastic member.

2. The portable organizer of claim 1 wherein said upper bracket includes a back, a front member extending outwardly from said back, and a flange extending upwardly from said front member and said lower bracket includes a back and a bottom member extending outwardly from said back of said lower bracket.

3. The portable organizer of claim 2 wherein said back of said upper bracket and said back of said lower bracket has means for retaining said elastic member on said bracket.

4. The portable organizer of claim 3 wherein said retaining means includes prongs.

5. The portable organizer of claim 1 wherein said clamp further includes means for maintaining said clamp in place, said maintaining means being attached to said case.

6. The portable organizer of claim 5 wherein said maintaining means is a cover.

7. The portable organizer of claim 1 wherein said upper and lower brackets include means for protecting the miniature electronic device.

8. The portable organizer of claim 7 wherein said protecting means includes a pad located on each of said brackets.

* * * * *

US006264029C1

(12) EX PARTE REEXAMINATION CERTIFICATE (5727th)

United States Patent
Motson

(10) Number: US 6,264,029 C1
(45) Certificate Issued: Mar. 27, 2007

(54) PORTABLE ORGANIZER

(76) Inventor: W. David Motson, 417 Columbia Blvd., Cherry Hill, NJ (US) 08002

Reexamination Request:
No. 90/007,693, Aug. 26, 2005

Reexamination Certificate for:

| | |
|---|---|
| Patent No.: | **6,264,029** |
| Issued: | **Jul. 24, 2001** |
| Appl. No.: | **09/559,026** |
| Filed: | **Apr. 27, 2000** |

(51) Int. Cl.
*B65D 85/00* (2006.01)

(52) U.S. Cl. ..... 206/320; 206/472
(58) Field of Classification Search ..... 206/305, 206/320, 472, 477
See application file for complete search history.

(56) References Cited

U.S. PATENT DOCUMENTS 2,976,985 A 3/1961 Kraus
6,264,029 B1 7/2001 Motson

*Primary Examiner*—Jimmy G. Foster

(57) ABSTRACT

A portable organizer which includes a foldable case having an interior compartment is disclosed. The case may have a zipper along its periphery. Located within the compartment are various holders for securing a wide variety of personal organizational items such as business cards, notepads, an identification card, etc. Also located within the compartment is an adjustable clamp which may be used to grip a personal data assistant device. The clamp includes an upper bracket, a lower bracket, and an elastic member attached to the brackets. The lower bracket may be secured to the case. The upper bracket should not be attached to the case. Covering the elastic member is a piece of material sewn or otherwise attached to the case. The cover acts as a guide in order to maintain the clamp in place. A personal data assistant, such as a miniature electronics device or PALM PILOT may be gripped by the clamp by extending the upper bracket upwardly so that the device may rest on the lower bracket and against the covering member. The upper bracket is then released so that the upper bracket grips the device and holds it in place. Rubber or foam pads may be placed on the upper and lower brackets where the device contacts the brackets so that the device is not scratched or otherwise damaged by the brackets.

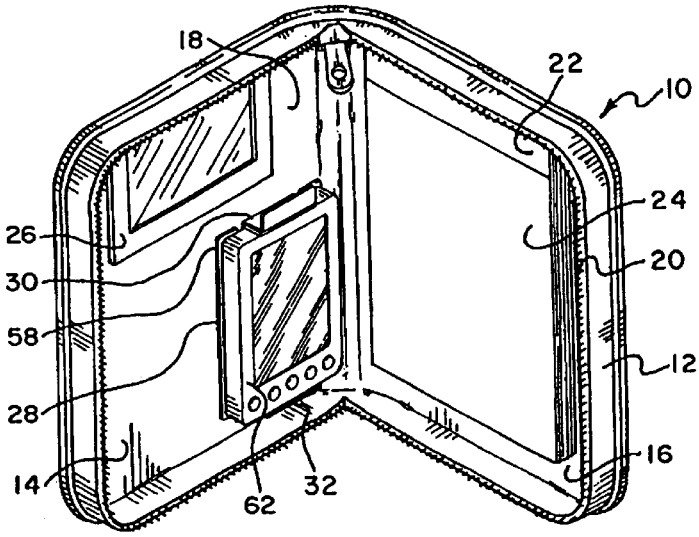

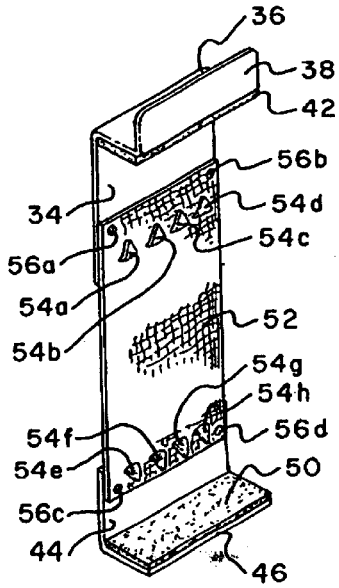

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 38–56:

The organizer includes a foldable case 12 having a left side 14, a right side 16 *of substantially the same size as the left side*, and an interior compartment 18. Along the periphery of the case 12 is a zipper 20 is a zipper 20 so that the case 12 may be folded *in half about the line that lies between the two sides* and zippered closed *with the zipper maintaining the case in the folded condition*. Secured within the case 12 *are a plurality of different types of holders that function independently of each other for simultaneously holding a plurality of diverse items. For example*, on the right side 16, is a holder 22 for a notepad 24. A pocket or holder 26 for a personal identification card is secured on the left side 14 and a holder in the form of an adjustable clamp 28 is also secured on the left side. (See FIG. 1.) It should be realized, however, that while only three holders are shown, a number of holders, such as straps, pockets, etc. may be located within the compartment and may hold a variety of personal organizational items such as a cellular phone, business cards, credit cards, keys, writing implements, etc. Furthermore, the arrangement of the holders within the case may vary. Also, it should be realized that the size of the case may vary. The case may be made from leather, vinyl, combinations of leather and fabric, or the like material. The holders may be made from plastic, metal, any like material, or any combinations thereof.

AS A RESULT OF REEXAMINATION, IT HAS BEEN DETERMINED THAT:

The patentability of claims 2–4, 7 and 8 is confirmed.

Claims 1, 5 and 6 are cancelled.

New claims 9–13 are added and determined to be patentable.

*9. A portable organizer for simultaneously holding a plurality of diverse items comprising:*

*a foldable case having an interior compartment and a plurality of different types of holders located therein and secured thereto, said holders functioning independently of each other for simultaneously holding a plurality of diverse items within said case, said case being comprised of two sides with at least one holder being secured to each of said two sides, said two sides being of substantially equal size and said case being foldable in half about a line that lies between said two sides, one of said holders on one of said sides including an adjustable clamp for securing a miniature electronic device, said clamp including an upper bracket, a lower bracket, and an elastic member attached to said upper and lower brackets, at least one of said brackets being moveable away from the other of said brackets and said brackets being biased toward each other by said elastic member.*

*10. The portable organizer of claim 9 further including means for maintaining said case in its folded condition.*

*11. The portable organizer of claim 10 wherein said maintaining means is a zipper.*

*12. The portable organizer of claim 9 wherein said upper and lower brackets include means for protecting the miniature electronic device.*

*13. The portable organizer of claim 12 wherein said protecting means includes a pad located on each of said brackets.*

* * * * *